United States Patent [19]

Spinosa et al.

[11] Patent Number: 4,934,030

[45] Date of Patent: Jun. 19, 1990

[54] PROJECTION FOR USE AS A RESTRAINING TOOTH IN A BELT RESTRAINT ASSEMBLY

[75] Inventors: Dominic Spinosa, Wantagh; Frank Knoll, Huntington Station, both of N.Y.

[73] Assignee: East/West Industries, Hauppauge, N.Y.

[21] Appl. No.: 691,553

[22] Filed: Jan. 15, 1985

[51] Int. Cl.[5] ..... A44B 11/10

[52] U.S. Cl. ..... 24/194; 188/65.1; 188/250 B; 242/107.2; 280/806

[58] Field of Search ..... 188/250 R, 250 B, 250 H, 188/65.1; 72/191, 196, 197, 703; 297/77, 476, 79, 478, 480; 242/107.2; 280/806; 24/115 K, 115 R, 194, 181, 316

[56] References Cited

U.S. PATENT DOCUMENTS

| | | | |
|---|---|---|---|
| 1,610,237 | 12/1926 | Belli | 24/316 |
| 1,850,944 | 3/1932 | Sanders | 24/194 |
| 3,587,140 | 6/1971 | Gaylord | 24/194 |
| 3,817,473 | 6/1974 | Board et al. | 297/476 |
| 3,950,826 | 4/1976 | Knoll et al. | 24/171 |

FOREIGN PATENT DOCUMENTS

| | | | |
|---|---|---|---|
| 2063735 | 6/1981 | United Kingdom | 72/196 |

*Primary Examiner*—George E. A. Halvosa
*Attorney, Agent, or Firm*—Hoffmann & Baron

[57] ABSTRACT

A projection for use as a restraining tooth in a compression-type belt restraint assembly which includes a base secured against movement and having a size and dimension appropriate for insertion of the projection in the interstices provided between the warp and weft of a woven fabric belt. The projection also includes a load-bearing surface, preferably an omnidirection load-bearing surface, projecting from the base at an angle from the perpendicular to the base so that a substantial component of the restraint force imparted by the surface on a fabric belt fiber under compression restraint is in the horizontal direction. Also the projection includes a nonabrasive top which terminates the omnidirectional surface so fibers comprising a fabric belt are not abraided or cut.

30 Claims, 2 Drawing Sheets

PROJECTION FOR USE AS A RESTRAINING TOOTH IN A BELT RESTRAINT ASSEMBLY

BACKGROUND OF THE INVENTION

The present invention relates to the art of belt restraint assemblies and, in particular, to compression type restraint mechanisms used as restraint harness adjusters.

It is known in the art of seat belt restraint systems to provide restraint harness adjustment assemblies in which a compression type restraint means or brake is used to prevent the belt from being pulled out of the adjustment under a load. Generally a restraint adjuster or slide buckle is a device which forms part of a seat belt system and has the function of providing an adjustment means for the length of the belt, harness, or webbing. The device usually includes a restraining means or brake which has a pair of cooperating jaw members mounted in operative relationship to a guide means. The jaw members can be movable in a housing in one direction toward a clamping position in which the jaw members, with the belt therebetween, are wedged together to retain the belt in a fixed position. When the belt is moved in the opposite direction between the jaw members, they are separable in order to allow the belt to freely move therethrough.

One of the devices known in the art is disclosed in U.S. Pat. No. 3,587,140 to Gaylord, et al. issued June 28, 1971, which describes an adjuster assembly that is intended to prevent accidental release of the belt or web so that the adjuster is able to support a predetermined load, and provide a means whereby the length of the belt can be quickly adjusted in either direction. Specifically, resilient means urge two plates to tightly grip the branch of the belt between them up to a predetermined load by the tension of springs attached to the plates, but when one of the gripping plates is pulled from the other, the clamping grip can be disengaged from the belt so as to permit the adjustment of the belt in the direction of pull by the load. Gripping elements on the opposing surfaces of the belt in the Gaylord, et al. patent are unidirectional, in order to resist movement in the direction of the load, but permit adjustment in the opposite direction. The assembly cover of Gaylord is considered quite complex and certain disadvantages have been realized as a result of such complexity.

More recently, U.S. Pat. No. 3,950,826 to Knoll, et al. discloses a seat belt assembly which overcomes many of the Gaylord, et al. problems and includes guide rods which are spaced apart fixed bearing surfaces assembled to side members of a support, and which are so located as to limit the forward travel of clamping members. There is a sloping surface on the clamping members which cam against the guide rods so that vertical displacement of the clamping members takes place. Elongated slots in the guide plates provide vertical freedom so that the clamping members tend to come together under the influence of the force provided by springs. The belt is free to move within the restraint adjuster in one direction without any need to utilize the release means provided, and the clamping means automatically reclamps itself against the belt when the adjustment is completed.

The Knoll, et al. disclosure provides for gripping surfaces on the clamping jaws which consists of rubber (or equivalent) pads whose function is to maintain strong pinching action without allowing fraying of the belt as would generally occur when metallic serrated surfaces, such as those of Gaylord, et al. are used. However, certain problems are incurred in the use of the rubber or similar material braking pads in that webbing slippage can occur at very cold temperatures. Other problems associated with using a rubber friction pad are that the rubber suffers deterioration with time and aging which relates to the nature of the rubber molecule—a long chain-like structure consisting of many smaller molecules joined together. Since it is believed that the bonds between these molecules are particularly susceptible to chemical reaction, at least three principle types of reactions are associated with such deterioration. The first one is scission in which the molecular bonds are cut dividing the chain into smaller segments. Ozone and ultraviolet light as well as radiation cause deterioration of this type. Another type of deterioration caused principally by heat and oxygen is cross-linking, which is an oxidation process whereby additional intermolecular bonds are formed. A third type of deterioration is modification of side groups which can change the complex in the weaker fringe areas of the molecular construction due to chemical reaction. Moisture, for example, could promote this type of activity.

These three types of reaction usually occur concurrently and in varying degrees. It is noted that all mechanisms by which rubber deteriorates, with time, are attributable to environmental conditions both in storage and actual service.

Accordingly, it is an object of the present invention to overcome these and other problems associated with providing a braking or restraint surface for a compression type restraint means in a belt assembly apparatus.

SUMMARY OF THE INVENTION

The present invention is a projection which can be used as a restraining tooth in a compression type belt restraint assembly, such as that used for adjusting the belt, which includes a base means secured against movement and has a size and dimension appropriate for insertion of the projection in the interstices provided between the warp and weft of a woven fabric belt. The projection also has a load-bearing surface, preferably an omni-directional surface, projecting from the base at an angle from the perpendicular to the base such that a substantial component of the restraint force imparted by the surface on a fabric belt under compression restraint is in the horizontal direction. Finally, the projection of the present invention has a top which terminates the load-bearing surface such that fibers comprising the belt are not abraided, frayed, or severed by the projection.

In one embodiment the projection is a truncated pyramid, but as one skilled in the art can easily determine, other configurations, such as a truncated cone, can also provide the necessary projection. When the projection takes the form of a truncated pyramid, the area of the base can be a square having side of from about 0.050 to about 0.115 inches in length, and the preferably the sides are from about 0.078 to 0.092 inches in length.

The projection is believed to be best suited for purposes of restraining by having a height from the base to the top of from about 0.015 to about 0.030 inches, while the preferred height is from about 0.020 to about 0.024 inches.

In order to provide the projection with an appropriate load-bearing surface it has been found that the angle of the surface from the perpendicular to the base can be from about 2° to about 65°, while the angle is preferably from about 35° to about 5020 The most preferred embodiment of the invention includes a substantially planar top so that the fabric threads are not damaged during use.

When used in the type of assembly provided by the Knoll, et al. patent, it is found that the present invention can be formed directly on the compression restraint means, but the invention also includes a braking pad for use with that compression type of belt restraint mechanism such as a substantially planar braking plate having two sides, the first side of which can be mounted on a compression restraint means in the assembly, while the second side includes at least one projection as described hereinabove which extends from the second side. Preferably, the braking pad can be made of metal, and has a plurality of such projections which can be fabricated by stamping. In one of the preferred embodiments of the invention the braking pad is made of anodized aluminum.

One suitable configuration for the braking pad of the invention is that it has a substantially rectangular shape on which the projections are in side by side relationship and arranged in a number of rows. The pad rectangle can have a length of from about 0.075 to about 2.00 inches and a width of from about 0.30 to about 1.50 inches, while the preferred embodiment includes a length of from abut 1.4 to about 1.8 inches and the width is from about 0.65 to about 0.85 inches.

It is contemplated that in one of the most preferred embodiments of the present invention a braking pad can be fabricated by machining/casting/kurling such that it can be made to fit in an existing restraint means which previously had a rubber type of friction restraint surface.

In a more particular sense, the braking pad of the present invention can be considered an improvement in a harness restraint adjuster having retaining means including a pair of cooperating clamping members for engagement with opposite sides of the restraint belt. The clamping members are normally closed on the belt to anchor it in a fixed position, but a means for manual release allows for disengagement of the clamping members to vary the length of the belt. The belt is free to move within the restraint adjuster in one direction without any need to utilize the release means, and the retaining means automatically reclamps itself against the belt when the adjustment is completed.

As a result of the present invention there is provided a new projection for use as a restraining tooth directly on such clamping member or on a braking pad mounted on the clamping member which results in a positive grip contact surface that overcomes the problems associated with low temperature conditions as well as deterioration usually associated with rubber type friction surfaces.

Furthermore, as a result of the present invention, a metal braking pad can be provided which does not contribute to the deterioration of the belt and which can be retrofitted into existing clamping restraint means.

Also the present invention provides a braking surface for a releasable clamping means which can be released with a minimum amount of force.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

Preferred embodiments of the invention have been chosen for purposes of illustration and description and are shown in the accompanying drawings, wherein:

FIG. 1*a* is an elevated cross-section of the pad of FIG. 1 taken along line 1a;

DETAILED DESCRIPTION OF THE INVENTION

Figure 1:
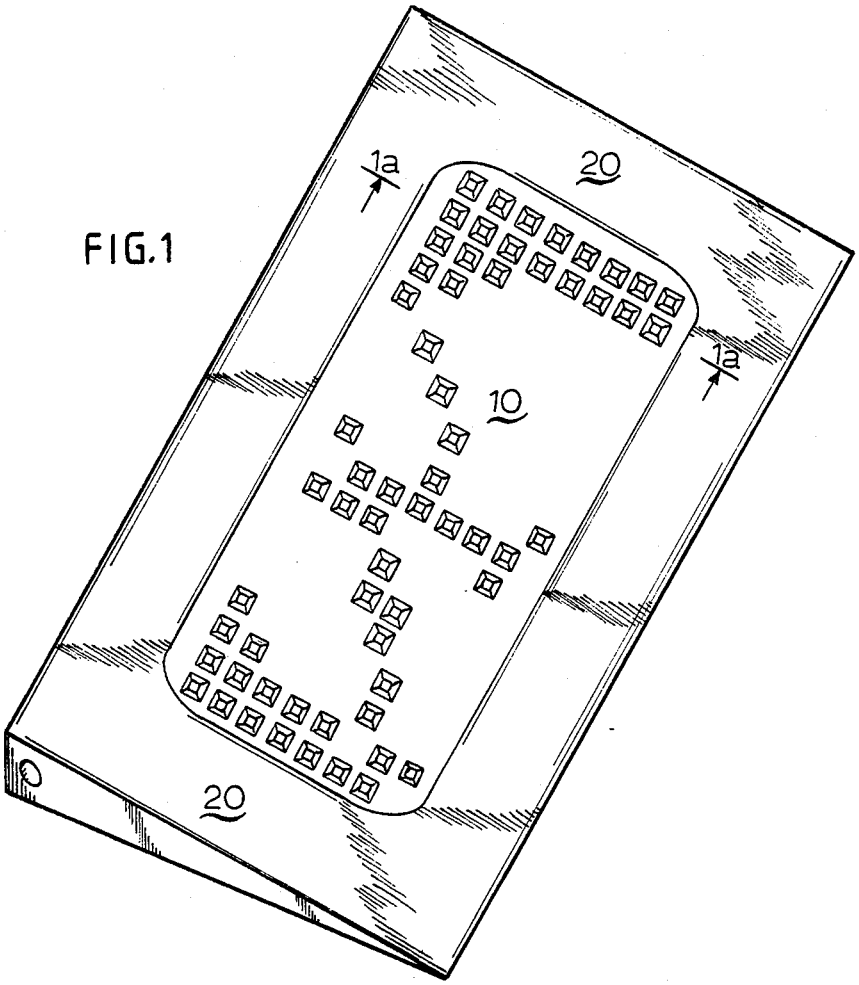
FIG. 1 is a perspective view of a braking pad having the projections thereon and mounted on one side of a clamp for a restraining means.

Referring to the drawings there can be seen a braking pad (10) mounted on one side of a clamp (20) of a restraining means in which there is shown a section of projections in accordance with the present invention. Specifically the projections shown therein are arranged in side-by-side relationship in a series of rows so that when the clamping means is clamped onto a fabric belt, the projections are forced against the weave of the fabric.

Figure 2:
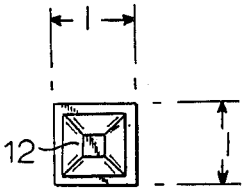
FIG. 2 is a plan view of a preferred embodiment of a projection in accordance with the present invention.

Referring in particular to FIG. 2 where there is shown a single projection, it can be seen that the base of the projection should be of a size such that the projection can be fit into the void or interstices provided between the warp and the weft thread of a woven fabric belt. This base can conveniently be a square having sides with a length (1) between from about 0.050 to about 0.115, and preferably from about 0.078 to about 0.092 inches. One preferred embodiment of the invention contemplates that the projection will be a truncated pyramid. In that case, referring to the FIGS. 2 and 3, when the projection is a truncated pyramid, it can have a load bearing surface (12) which has an angle (a) from the perpendicular (p) to the base such that a substantial component of the restraining force on the belt is in horizontal direction. This angle can be from about 2° to about 65° and is preferably from about 35° to about 50°, while the height of the projection (h) can be from about 0.015 to about 0.030 and is preferably from about 0.020 to about 0.024 inches. In a preferred embodiment of the invention, i.e., when the projection is a truncated pyramid, the top is substantially planar or flat having a width (w) of from about 0.030 to about 0.060 inches. In this way the projection nests in the voids provided by the spaces in the fabric weave pattern so that the restraining force exerted against the belt is exerted by the sides of the projection against the warp or weft threads of the fabric.

Figure 3:
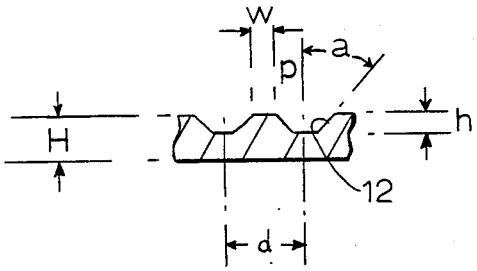
FIG. 3 is a detailed cross-section of projections according to the present invention in side to side relationship.

Generally, when the configuration is that shown in FIG. 1, every projection lays inside the nap of the webbing. This design is optimal whether the webbing or belt fabric is coated or uncoated. It is also believed to be highly effective when the belt is a polymer, such as a synthetic rubber in which case there are no interstices created by the weave of the fabric. When the projection is mounted on a generally rectangular brake plate as shown in FIGS. 1 and 3, the overall height (H) of the cross-section can be from about 0.025 to about 0.100 inches, preferably from about 0.035 to about 0.065 inches, and is most preferably about 0.050 inches.

Figure 1A:
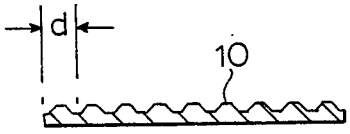

Referring now to FIG. 1*a* there is shown a cross-section taken along line (1a—1a) in FIG. 1 in which the rows of teeth can be seen as the pitch of the teeth (d) shown in FIG. 1*a* can be from about 0.045 to about 0.175 and is preferably from about 0.075 to about 0.095 inches, but is most preferably about 0.085 inches to mesh ideally with the nap of the web. The series or rows of teeth as shown in FIG. 1*a* are nested into the voids in the fabric weave so that when the belt is pulled against the teeth the restraining force exerted on the belt is substantially in the horizontal direction.

Figure 5:
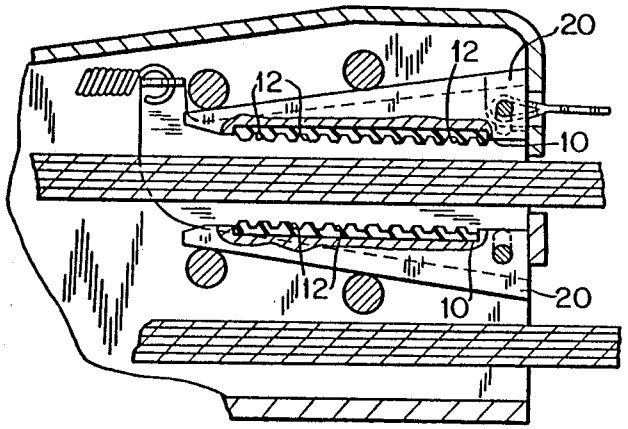
FIG. 5 is a partial cross-sectional view of the assembly shown in FIG. 4 with its cooperating jaws in an unlocked position.
Figure 4:
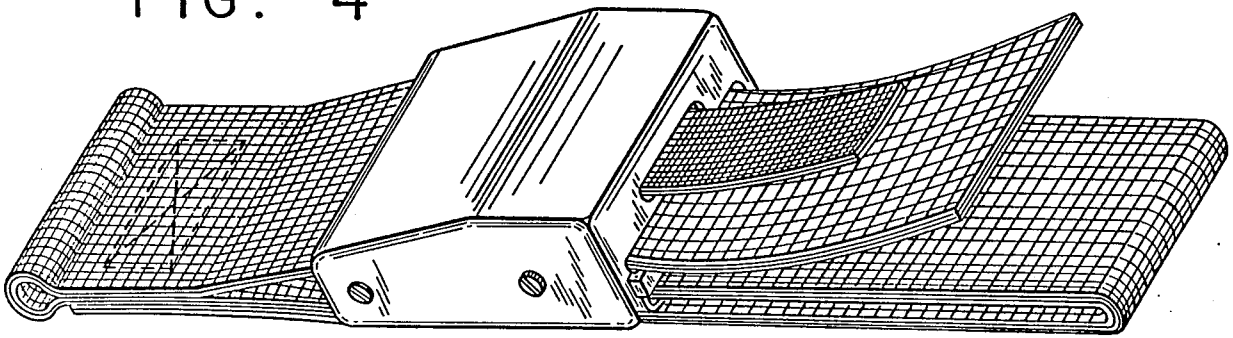
FIG. 4 is a perspective view of a slide-buckle compression-type belt restraint assembly in which the present invention can be used.

As a result of the present invention, a highly effective restraint tooth-bearing braking pad can be retrofitted into existing restraint harness adjusters so that problems experienced with rubber braking pads due to extreme cold temperature are overcome and immunity to aging and chemically adverse environments is provided. (See FIG. 5) As an added advantage, the present restraint tooth design and pad provides a restraint or a braking means which can be easily released by a low pull force on a release mechanism such as that shown in the Knoll, et al. patent, e.g., of less than about 15 lbs and preferably less than 10 lbs.

Tests have been conducted comparing the performance of the projection and brake pad of the present invention to a rubber pad and a unidirectional sawtooth surface (e.g., as in Gaylord, et al.) in a restraint assembly of the Knoll, et al. type. Specifically, toothed pads made from aluminum alloy and anodized were retrofitted into such assemblies (as in FIG. 5) in the place of the synthetic rubber pads and tested for strength, slippage, belt damage, and for low temperature performance. Each assembly was equipped with a nylon webbing harness belt.

Specifically, in one test the adjusters were fastened between upper and lower platens of a tensil testing machine and a load of 7000 lbs. was applied and maintained for 30 seconds in a first test, and a load of 6880 lbs was applied for 30 seconds in a second test. No slippage was observed under test conditions of below −70° F. for the braking pad of the present invention, whereas the webbing slipped through the rubber pad-bearing clamps. Even the sawtooth design of Gaylord, et al. resulted in slippage at loads above about 3000 lbs, and the webbing exhibited extensive abrasion in the contact area. Thus, the unidirectional sawtooth design has not entirely overcome slippage problems, and serious problems of belt destruction are still incurred.

In life cycle testing, a repeated test cycle was performed while a 50 lbs. tensile load is exerted on the mechanism. A force was applied to the release tab resulting in the operation of the release mechanism so that a minimum 6 inch movement of the webbing through the adjuster was permitted. The adjuster assembly was retightened to the original position by pulling on the free end of the webbing assembly. During the retightening operation, a minimum of a 25 lbs. tensile load was applied to the adjuster assembly. The movement and loading simulated actual webbing usage. The test units were cycled 5000 times. No visable effects on the webbing were detected at the completion of the testimony using the aluminum pads with truncated pyramids.

Finally, tests were conducted to determine whether the excellent restraining aluminum braking pads require excess force to effect a release mechanism such as in the Knoll, et al. harness adjuster. The adjuster mechanism loaded with a constant 25 lbs. force while a steady pull in the release direction is applied to the release tab. The passing criteria established was that a release force of not more than 10 lbs. be required to actuate the release mechanism, while there was no observed drag on the webbing resulting from improper operation of the locking mechanism and there was no slippage of webbing through the adjuster while under a 25 lb. load. The aluminum projection-bearing pad passed in every instance.

In conclusion, therefore, it can be seen that the projection and brake pad of the present invention overcomes problems associated with rubber braking pads without the drawbacks normally associated with metal projection-bearing type pads.

Thus, while there have been described what is presently believed to be the preferred embodiments of the present invention, those skilled in the art will realize that changes and modifications may be made thereto without departing from the spirit of the invention, and it is intended to claim all such changes and modifications as fall within the true scope of the invention.

We claim:

1. A compression-type fabric belt restraint assembly braking pad which an be used on cooperating jaws in compression restraint means of a compression-type belt restraint assembly comprising a substantially planar braking surface which is oriented toward the surface of said belt as said belt passes through said assembly, at least one belt-restraining projection secured on said surface which has a size and dimension for insertion of said projection in the interstistices provided between the warp and weft of said belt, said projection having a continuous omnidirectional wall projecting from said surface at a constant absolute angle from the perpendicular to said surface whereby restraining said belt under compressive forces and releasing said belt under release force are facilitated, said projection further having a substantially flat top terminating said continuous wall, whereby fibers comprising said belt are substantially free from being abraided under repeated use.

2. The braking pad of claim 1 wherein said projection is a truncated pyramid.

3. The braking pad of claim 2 wherein said pyramid has a square base having sides of from about 0.050 to about 0.115 inches in length.

4. The braking pad of claim 3 wherein said sides are from about 0.078 to about 0.092 inches in length.

5. The braking pad of claim 1 wherein said projection has a height from said surface to said top of from about 0.015 to about 0.030 inches.

6. The braking pad of claim 5 wherein said height is from about 0.020 to about 0.024 inches.

7. The braking pad of claim 1 wherein said angle of said continuous wall from said perpendicular to said surface is from about 2° to about 65°

8. The braking pad of claim 7 wherein said angle is from about 35° to about 50°.

9. The braking pad of claim 1 wherein the greatest cross-sectional extension of said top of said projection is from about 0.030 to about 0.060 inches.

10. The braking pad of claim 1 wherein there are a plurality of said projections.

11. The braking pad of claim 10 which is a substantially rectangular plate for mounting on said jaws on which said projections are in side-by-side relationship and arranged in a number of rows.

12. The braking pad of claim 11 wherein said rectangular plate has a length of from about 0.075 to about 2.00 inches and a width of from about 0.30 to about 1.50 inches.

13. The braking pad of claim 12 wherein said length is from about 1.40 to about 1.80 inches and said width is from about 0.65 to about 0.85 inches.

14. The braking pad of claim 1 which is made of metal and wherein said projection is formed by one of machining, coining, and knurling.

15. The braking pad of claim 14 which is made of anodized aluminum.

16. In combination with a compression-type belt assembly having belt-clamping jaws which grip a belt passing therebetween when said jaws are under compression, improved gripping means on each said jaw, said gripping means comprising:

a substantially planar braking surface which is oriented toward the surface of said belt as said belt passes through said assembly, at least one belt-restraining projection secured on said surface which has a size and dimension for insertion of said projection in the interstistices provided between the warp and weft of said belt, said projection having a continuous omnidirectional wall projecting from said surface at a constant absolute angle from the perpendicular to said surface whereby restraining said belt under compressive forces and releasing said belt under release force are facilitated, said projection further having a substantially flat top terminating said continuous wall, whereby fibers comprising said belt are substantially free from being abraided under repeated use.

17. The gripping means of claim 16 wherein said projection is a truncated pyramid.

18. The gripping means of claim 17 wherein said pyramid has a square base having sides of from about 0.050 to about 0.115 inches in length.

19. The gripping means of claim 18 wherein said sides are from about 0.078 to about 0.092 inches in length.

20. The gripping means of claim 16 wherein said projection has a height from said surface to said top of from about 0.015 to about 0.030 inches.

21. The gripping means of claim 20 wherein said height is from about 0.020 to about 0.024 inches.

22. The gripping means of claim 16 wherein said angle of said continuous wall from the perpendicular to said base is from about 2° to about 65°.

23. The gripping means of claim 22 wherein said angle is from about 35° to about 50°.

24. The gripping means of claim 16 wherein the greatest cross-sectional dimension of said top of said projection is from about 0.030 to about 0.060 inches.

25. The gripping means of claim 16 wherein there are a plurality of said projections.

26. The gripping means of claim 25 which is a substantially rectangular plate for mounting on said jaws on which said projections are in side-by-side relationship and arranged in a number of rows.

27. The gripping means of claim 26 wherein said rectangular plate has a length of from about 0.075 to about 2.00 inches and a width of from about 0.30 to about 1.50 inches.

28. The gripping means of claim 27 wherein said length is from about 1.40 to about 1.80 inches and said width is from about 0.65 to about 0.85 inches.

29. The gripping means of claim 16 which is made of metal and wherein said projection is formed by one of machining, coining, and knurling.

30. The gripping means of claim 29 which is made of anodized aluminum.

* * * * *